US005826751A

United States Patent [19]

Stahley et al.

[11] Patent Number: 5,826,751

[45] Date of Patent: Oct. 27, 1998

[54] REPLACEABLE FLUID-CONTAINING BAG AND NOZZLE FOR HIGH VISCOSITY FLUID DISPENSER

[75] Inventors: Robert E. Stahley, Middletown; Dana P. Gruenbacher, Fairfield, both of Ohio

[73] Assignee: The Procter & Gamble Company, Cincinnati, Ohio

[21] Appl. No.: 953,524

[22] Filed: Oct. 17, 1997

Related U.S. Application Data

[62] Division of Ser. No. 641,609, May 1, 1996.

[51] Int. Cl.[6] ..... B65D 35/29

[52] U.S. Cl. ..... 222/92; 222/95; 222/107; 222/326; 222/387; 222/386

[58] Field of Search ..... 222/92, 95, 107, 222/105, 325, 326, 386, 386.5, 387, 389

[56] References Cited

U.S. PATENT DOCUMENTS

| | | | |
|---|---|---|---|
| 2,616,422 | 11/1952 | Jones | 222/95 X |
| 3,166,221 | 1/1965 | Nielsen | 222/137 |
| 3,304,977 | 2/1967 | Hammons | 150/1 |
| 3,323,682 | 6/1967 | Creighton, Jr. | 222/94 |
| 3,561,644 | 2/1971 | Words et al. | 222/95 |
| 4,147,279 | 4/1979 | Matsui | 222/95 |
| 4,322,018 | 3/1982 | Rutter | 222/83 |
| 4,362,255 | 12/1982 | Bond | 222/107 |
| 4,378,069 | 3/1983 | Franco | 206/620 |
| 4,415,085 | 11/1983 | Clarke et al. | 222/107 X |
| 4,484,351 | 11/1984 | De Leeuwe et al. | 383/9 |
| 4,732,299 | 3/1988 | Hoyt | 222/94 |
| 4,801,046 | 1/1989 | Miczka | 222/95 |
| 4,842,165 | 6/1989 | Van Coney | 222/95 |
| 4,880,125 | 11/1989 | Lebeau | 215/11.3 |
| 4,972,969 | 11/1990 | Randklev | 221/1 |
| 4,989,758 | 2/1991 | Keller | 222/137 |
| 5,020,694 | 6/1991 | Pettentgill | 222/137 |
| 5,038,963 | 8/1991 | Pettengill et al. | 222/145 |
| 5,076,471 | 12/1991 | Coleman | 222/105 |
| 5,092,496 | 3/1992 | Gayle et al. | 222/319 X |
| 5,226,563 | 7/1993 | Coggiola | 222/95 |

(List continued on next page.)

FOREIGN PATENT DOCUMENTS

| | | | |
|---|---|---|---|
| 2294927 | 12/1974 | France | 222/95 |
| 461207 | 1/1951 | Italy | 222/326 |
| 136996 | 2/1930 | Switzerland | 222/326 |
| 386298 | of 1909 | United Kingdom . | |
| 1103917 | 2/1968 | United Kingdom | F04B 19/20 |

OTHER PUBLICATIONS

U.S. application No. 08/588,488, Stahley, filed Jan. 18, 1996.

U.S. application No. 08/790,130, Gruenbacher, filed Jan. 29, 1997.

*Primary Examiner*—Kenneth Bomberg

*Attorney, Agent, or Firm*—R. W. Kock; William Scott Andes; Jack L. Oney, Jr.

[57] ABSTRACT

A dispenser comprises an upper portion having an annular member depending therefrom and a bottom portion having a base and an upright post connected to the base. It also includes a flexible bag capable of containing fluid suspended from the upper portion and located inside the annular member. The flexible bag has a nozzle connected to it such that the flexible bag is closed except at the nozzle. The nozzle has a discharge orifice in fluid communication with the flexible bag. The upper portion telescopingly engages the bottom portion such that the upright post is located substantially aligned with the flexible bag. The upright post is sized to cause the flexible bag to invert when the upper portion and the bottom portion are pressed together. An openable closure closes the discharge orifice so that a fluid-containing flexible bag may be easily handled for replacement of the emptied flexible bag in the dispenser. A removable rigid cover connected to the upper portion provides a surface against which a user may conveniently press the upper portion downward with a palm of the hand. The rigid cover is removable from the upper portion to enable the flexible bag to be replaced.

9 Claims, 4 Drawing Sheets

U.S. PATENT DOCUMENTS

| | | | |
|---|---|---|---|
| 5,271,528 | 12/1993 | Chien | 222/63 |
| 5,295,615 | 3/1994 | Gentile | 222/327 |
| 5,305,920 | 4/1994 | Reiboldt et al. | 222/95 |
| 5,305,921 | 4/1994 | Kock et al. | 222/95 |
| 5,332,124 | 7/1994 | Cancro et al. | 222/137 |
| 5,335,827 | 8/1994 | Gentile | 222/137 |
| 5,348,392 | 9/1994 | Bouquet et al. | 366/162 |
| 5,454,486 | 10/1995 | Mack et al. | 222/95 |
| 5,667,102 | 9/1997 | Keller | 222/95 |

REPLACEABLE FLUID-CONTAINING BAG AND NOZZLE FOR HIGH VISCOSITY FLUID DISPENSER

This is a division of application Ser. No. 08/641,609, filed on May 1, 1996.

FIELD OF THE INVENTION

The present invention relates to high viscosity fluid dispensers which utilize an upper portion pressed downward against a rigid post in a lower portion, and more particularly to such dispensers wherein toothpaste is dispensed from a replaceable fluid container.

BACKGROUND OF THE INVENTION

Dispensers of high viscosity fluids may require significant force input from the user in order to initiate dispensing. Pushing downward with the palm of one's hand has been found to be an ergonomically efficient way for a user to develop sufficient force to dispense high viscosity fluids, such as toothpaste. Positive displacement pumps which utilize this approach have become available recently. An example is the Mentadent™ toothpaste co-dispenser, a Trademark of Chesebrough-Pond's USA Co. of Greenwich, Conn.; which is disclosed in U.S. Pat. Nos. 5,295,615, and 5,335,827 to Gentile. The Mentadent co-dispenser has an upper portion containing two cylinders, each filled with different components of a toothpaste. At the end of each cylinder is a piston frictionally engaged in its cylinder to prevent leakage of toothpaste fluid from the cylinder. The upper portion is telescopingly connected to a bottom portion having two upright posts of equal length, which are spaced apart so as to align with the cylinders of the upper portion. When a user presses downward on the upper portion, the pistons are pressed against the two fixed posts. Such pressure causes the pistons to move upward into the cylinders and to drive toothpaste fluids from each cylinder through separate discharge orifices connected to the top of the cylinders. The amount of fluid dispensed from each cylinder is determined by the distance the upper portion is pushed downward and the diameters of the two cylinders.

The Mentadent positive displacement toothpaste dispenser suffers from several deficiencies. First, the pistons provide considerable frictional resistance to movement in the cylinders when they are tight enough to prevent fluid leakage. High static friction and high fluid yield point require users to press hard to initiate dispensing. As a result, hard pressing to initiate flow must be immediately followed by lighter pressing to control displacement in order to avoid dispensing too much fluid. Such control is difficult for many users. Second, piston and cylinder arrangements require accurately molded or machined parts for adequate fit and reproducible operation. Such part accuracy is expensive.

A dispenser which avoids static friction and the need for accurate part requirements offers better function and lower manufacturing costs. In the caulking gun art, others have attempted to solve a similar friction problem by placing one or more flexible fluid-containing bags against a movable ram. For example, U.S. Pat. No. 3,323,682 to Creighton, Jr., et al. shows a ram pressed against the closed end of two side-by-side bags. The ram crushes the bags and fluid is dispensed from the opposite end of the bags. That is, each bag wrinkles axially as it shortens in length. Thin bags can be crushed nearly flat. However, even bag crushing may provide frictional resistance to dispensing because as the bag is crushed, the wrinkles typically slide along the cylinder wall. Also, any cocking of the ram relative to the cylinder may cause the bag wrinkles to jam between the ram and the cylinder wall.

Another type of toothpaste dispenser is the Crest Neat Squease™ dispenser, a trademark of The Procter & Gamble Company of Cincinnati, Ohio; which is disclosed in U.S. Pat. No. 4,842,165 to Van Coney. A squeezebottle has a fluid-containing bag housed inside the squeezebottle along with one-way air and fluid valving. Together these elements enable air pressure to be developed inside the squeezebottle and outside the bag which causes the bag to invert and thereby push out the toothpaste from the bag. An inverting bag has minimal friction resistance because the bag wall behaves like a rolling diaphragm. That is, the fold at the inverting point progressively moves from the closed end of the bag toward the discharge end. Such a dispenser can also be designed to discharge virtually all of its contents if the closed end of the bag matches the shape of the inside of the discharge end of the dispenser.

The Crest Neat Squeeze dispenser is a single use dispenser. When empty, the entire dispenser is discarded. Squeezebottles with bags and valving are more expensive than conventional toothpaste tubes. Thus, there is value in reusing the squeezebottle with its valving and replacing fluid-containing bags in order to reduce the average package cost per unit of fluid delivered.

Replacement bags are difficult to manage with such a dispenser, however, because the dispenser utilizes trapped air for dispensing. Reestablishing an air-tight seal after bag replacement is a problem because every user cannot be depended upon to provide adequate sealing. For example, when an expensive threaded engagement between rigid components is provided to generate a seal, users do not torque the components to the same degree.

U.S. Pat. No. 5,305,920 to Reiboldt et al. shows a Crest Neat Squeeze dispenser having a replacement cartridge with threaded components at the base of the dispenser. U.S. Pat. No. 5,454,486 to Mack et al. shows a similar dispenser having threaded components at the top of the dispenser. In both references not only is there an air sealing issue, but also there is a hygiene issue associated with toothpaste. Toothpaste is known for unsanitary-looking residue buildup on nozzles of tubes. The shape of the Crest Neat Squeeze nozzle is designed to minimize such buildup, but users still prefer a new nozzle with each new container of toothpaste. Replacing the nozzle with the bag results in the discharge valve also being replaced.

Therefore, what is missing in the prior art is a dispenser which utilizes the low friction of an inverting bag, and which has a replacement bag & nozzle that avoids both a discharge valve being discarded with each nozzle and user generated air-tight sealing.

OBJECTS OF THE INVENTION

It is an object of the present invention to provide a closable flexible bag, capable of containing fluid and having a nozzle attached, for use in a high viscosity fluid dispenser, such that the bag and nozzle and closure may be replaced when the bag is emptied while the other components of the dispenser may be reused.

It is another object of the present invention to provide a dispenser which has a fluid-containing bag that may be collapsed with mini friction, by inverting the bag against a stationary post in order to dispense fluid from within the bag.

It is yet another object of the present invention to provide a high viscosity fluid dispenser which requires minimal part accuracy, no valving, and no air-tight seals.

It is an additional object of the present invention to provide a dispenser which may be operated in an upright position by pressing an upper portion downwardly against a counter-top with the palm of the hand, or which may be operated in a user's hand by pressing telescoping portions together between palm and fingers.

SUMMARY OF THE INVENTION

In one aspect of the present invention, a dispenser comprises an upper portion and a bottom portion. The upper portion has an annular member depending therefrom. The bottom portion has a base and an upright post connected to the base. The upper portion telescopingly engages the bottom portion such that the upright post is located substantially aligned with the annular member. The upright post is sized to invert a flexible bag when the flexible bag is connected to the upper portion and located inside the annular member. The flexible bag is inverted when the upper portion and the bottom portion are pressed together.

In another aspect of the present invention, a dispenser comprises an upper portion, a bottom portion, and a flexible bag capable of containing fluid. The upper portion has an annular member depending therefrom. The flexible bag is suspended from the upper portion and is located inside the annular member. The flexible bag has an inside and a nozzle connected to the flexible bag such that the flexible bag is closed except at the nozzle. The nozzle has a discharge orifice in fluid communication with the inside of the flexible bag. The bottom portion has a base and an upright post connected to the base. The upper portion telescopingly engages the bottom portion such that the upright post is located substantially aligned with the annular member. The upright post is sized to cause the flexible bag to invert when the upper portion and the bottom portion are pressed together. The flexible bag has a bag wall thickness and a bag wall which slidably fits inside the annular member, and the upright post has an outer dimension which is less than an inner dimension of the annular member by more than four of the bag wall thicknesses.

The dispenser may further comprise an openable closure connected to the discharge orifice so that when the closure closes the discharge orifice, the flexible bag may be easily handled for removal and replacement from the upper portion without inadvertent fluid discharge.

The dispenser may further comprise a rigid cover connected to the upper portion. The rigid cover provides a surface against which a user may conveniently press the upper portion downward. The rigid cover may be removable from the upper portion to enable the flexible bag to be replaced in the upper portion.

BRIEF DESCRIPTION OF THE DRAWINGS

While the specification concludes with claims which particularly point out and distinctly claim the present invention, it is believed that the present invention will be better understood from the following description of preferred embodiments, taken in conjunction with the accompanying drawings, in which like reference numerals identify identical elements and wherein:

DETAILED DESCRIPTION OF THE INVENTION

Figure 1:
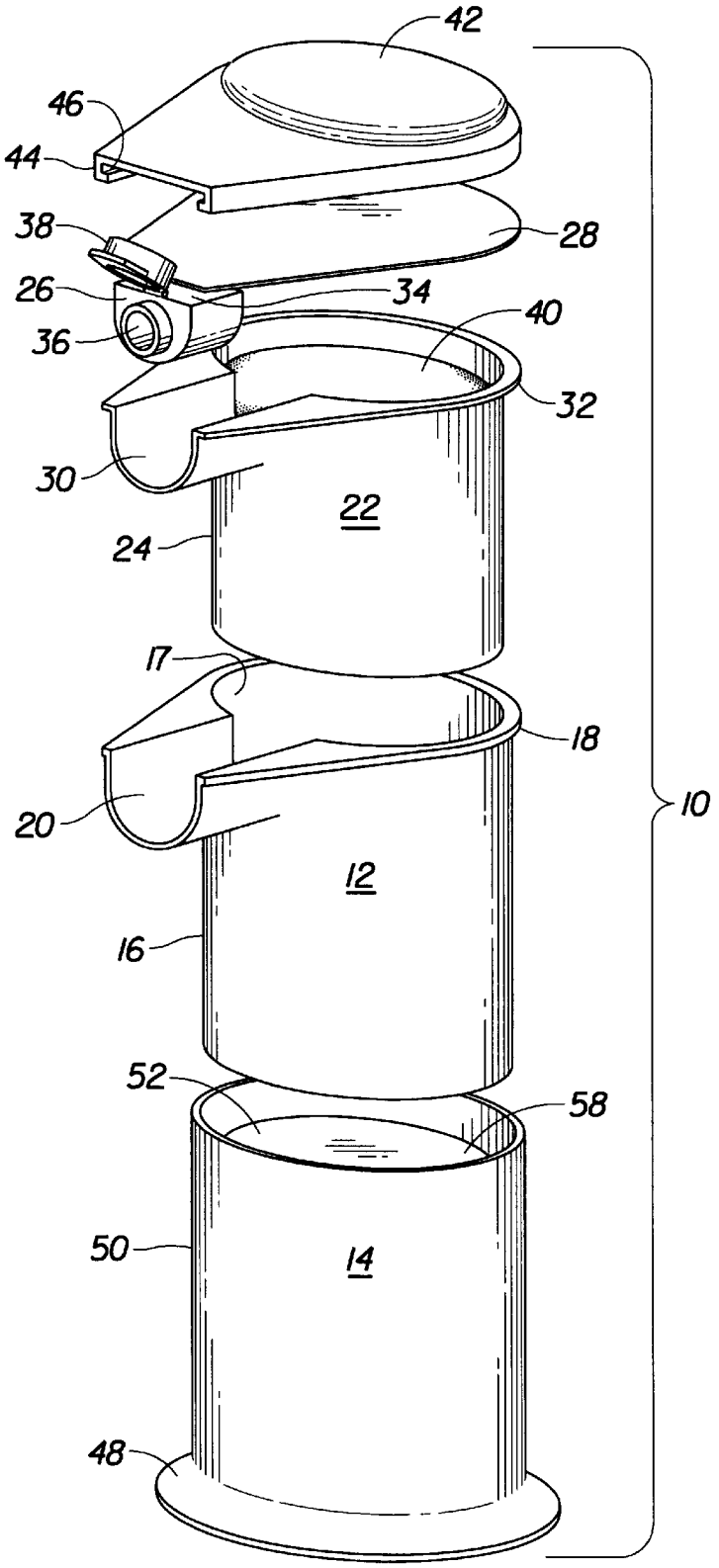
FIG. 1 is an exploded perspective view of a preferred embodiment of the dispenser of the present invention, disclosing (from top to bottom): a rigid cover, a film closure, a nozzle with flip-top closure, a flexible bag filled with fluid, an upper portion having a depending annular member, and a bottom portion having a base and an internal post.

Referring now to the drawings of the present invention, and more particularly to FIG. 1, there is shown a first preferred embodiment of a dispenser having a replaceable fluid-containing bag and nozzle, which is generally indicated as 10. Dispenser 10 is an upright counter-top dispenser intended to be operated by a user pressing downwardly against telescoping parts to dispense viscous fluid through a substantially horizontal nozzle. Dispenser 10 has an upper portion 12 and a bottom portion 14 which telescope together. Portions 12 and 14 may have cylindrical or non-cylindrical shapes and either portion may telescope within the other portion.

Figure 5:
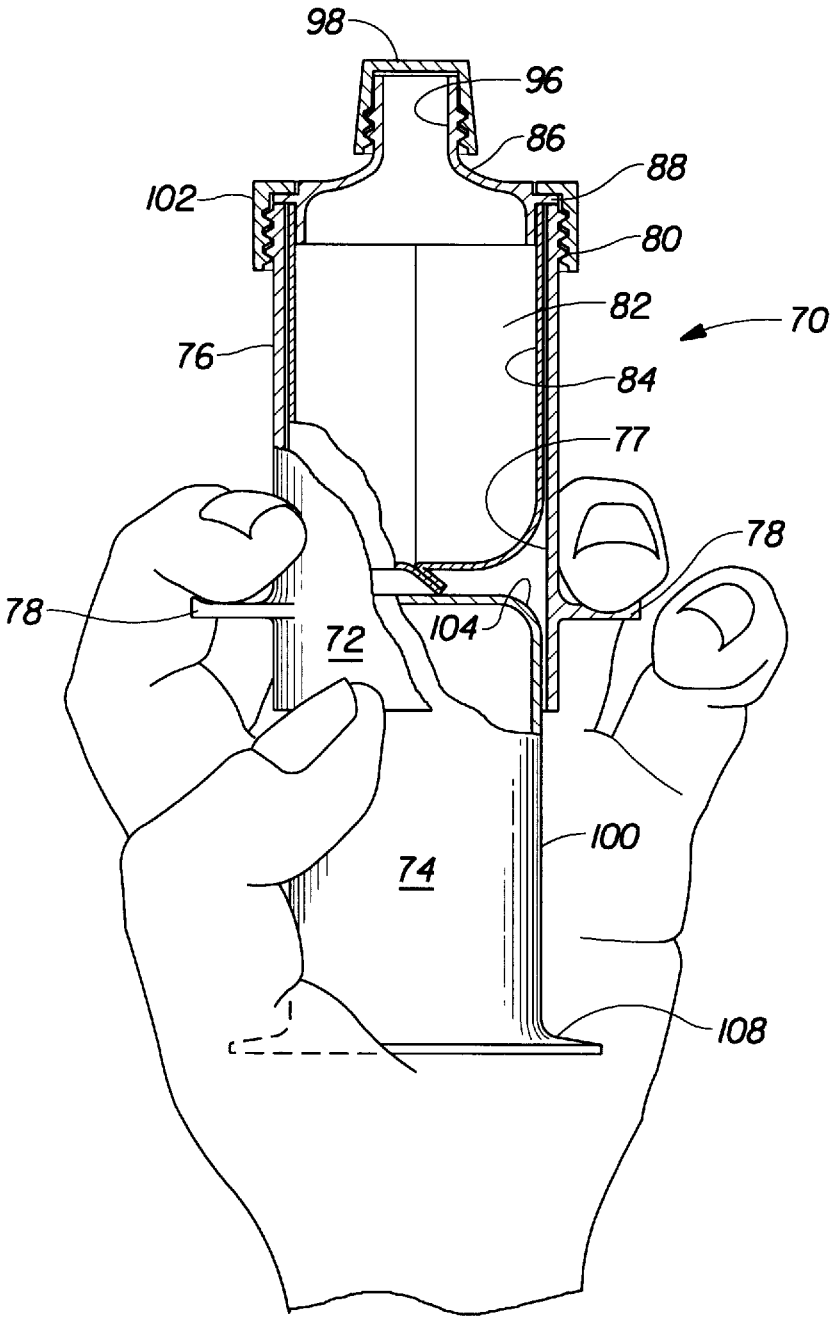
FIG. 5 is a sectioned side elevation view of an alternative embodiment of the dispenser of the present invention, disclosing a flexible bag connected to an a upright nozzle having a flange which is clamped against an upper portion by a threaded collar, wherein the upper portion has finger grips for engaging the upper portion with a post in order to invert the flexible bag and dispense fluid.

Upper portion 12 has an annular member 16 and a flange 18 and a nozzle support yoke 20. Annular member 16 has an inner surface 17. Slidably fitting into inner surface 17 is a flexible bag 22, which has sidewall 24, a nozzle 26, a bag closure 28, a nozzle portion 30, and a bag flange 32. nozzle 26 preferably has a flat top surface 34, an orifice 36 extending through nozzle 26 and in fluid communication with the inside of bag 22, and an openable nozzle closure 38 adapted to close orifice 36. Nozzle closure 38 may be a flip-top cap, as shown in FIG. 1 or a screw-on cap as shown in FIG. 5. A hinged snap-on cap is particularly preferred because it may be molded as part of the nozzle.

Figure 2:
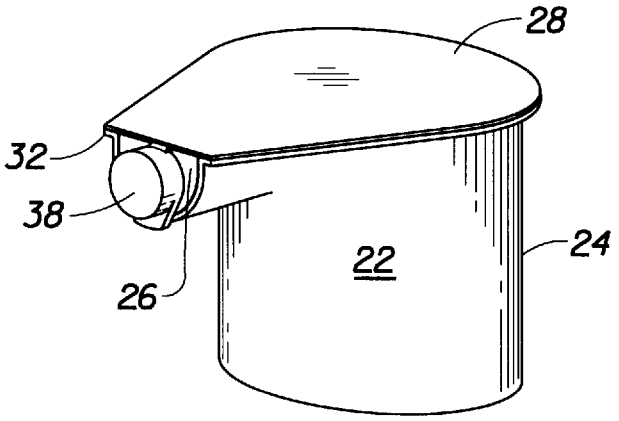
FIG. 2 is a perspective view of the assembled film closure, flexible bag, and nozzle of FIG. 1, disclosing the flip-top closure closed and the film closure sealed to the flange of the flexible bag and to the flat portion of the nozzle.

Bag 22 is preferably preassembled as a replacement cartridge, as shown in FIG. 2. That is, bag 22 is a thermoformed, pressblown, injection-blown, or folded and sealed film structure filled with a viscous fluid 40. Nozzle 26 is placed into nozzle portion 30; bag closure 28, which is preferably a piece of film, is placed on top of bag flange 32 and nozzle 26; and the bag and nozzle and bag closure are all sealed together at bag flange 32, at flat top surface 34, and at nozzle portion 30. Nozzle closure 38 is preferably closed to seal the fluid in bag 22 during handling of bag 22 as a replacement cartridge.

When bag 22 is slidably assembled into annular member 16 of upper portion 12, a removable rigid cover 42 may be connected to upper portion 12 in order to form a surface against which the user's palm may comfortably press downwardly. Rigid cover 42 may have a lip 44 and perimeter groove 46 which permits cover 42 to be snap-fit onto flange 18, thereby trapping bag flange 32 and bag closure 28 between flange 18 and cover 42. The snap-fitting arrangement may best be seen in FIG. 3.

Alternatively, bag 22 may be sealed to flange 18 of upper portion 12. When bag 22 is connected to upper portion 12 by a seal at flange 18, rigid cover 42 is not required for the dispenser to operate. However, pressing against a rigid surface to actuate the dispenser is desirable. To provide the rigid surface, a rigid bag closure could replace piece of film 28. Such a rigid bag closure could also have a lip and groove for snap-fitting onto flange 18.

Figure 3:
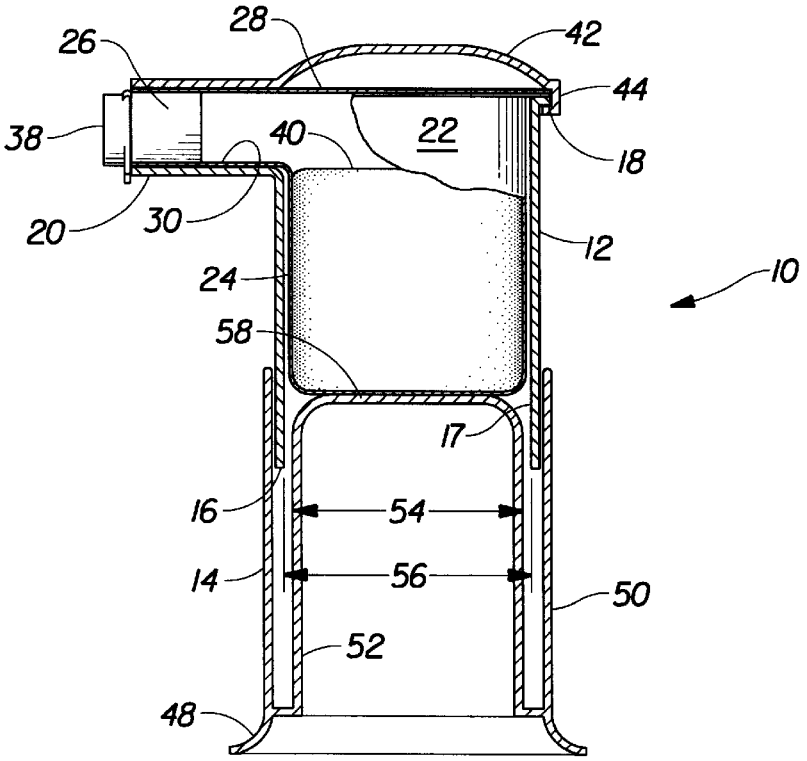
FIG. 3 is a sectioned side elevation view of the assembled dispenser of FIG. 1, showing the flexible bag assembly of FIG. 2 connected to a flange of the upper portion, the rigid cover snapped onto the upper portion, and the upper portion telescopingly engaged with the bottom portion.

Bottom portion 14 preferably has a base 48 and an upright annular member 50, which telescopingly engages annular member 16, preferably outside of annular member 16. Centered within upright annular member 50 and also connected to base 48 is an upright post 52. Post 52 is aligned with inner surface 17 of annular member 16, but clears surface 17 by more than four thicknesses of bag sidewall 24. Preferably, post 52 has an outer dimension 54 which is equivalent to an inner dimension 56 of inner surface 17 less four bag sidewall thicknesses less about 0.75 mm. These dimensions are seen in FIG. 3. With this amount of clearance, post 52 will cause bag 22 to invert when post 52 is pressed against the bottom of bag 22, as seen in FIG. 4.

Inverting is a phenomenon whereby bag sidewall 24 is thin enough and large enough in diameter that it may be progressively turned inside out without wrinkling. Post 52 has a rounded top end 58 which first contacts bag 22 and starts turning it inside out. This is best seen in FIG. 4. As bag 22 continues to turn inside out, a circumferential bag folding line 60 moves with the post at half the rate of post motion into annular member 16. Folding line 60 appears to "roll" as the bag sidewall progressively inverts. Because thin bag material is folding and then straightening at line 60, there is minimal frictional resistance. This compares favorably to the condition where a bag collapses by being crushed. When a bag is crushed, as would occur if clearance between post 52 and inner surface 17 were insufficient for inverting, wrinkles form and accumulate. Friction generated within wrinkles and between wrinkles and post 52 and inner surface 17 would create substantially greater resistance to bag collapse than inverting.

Figure 4:
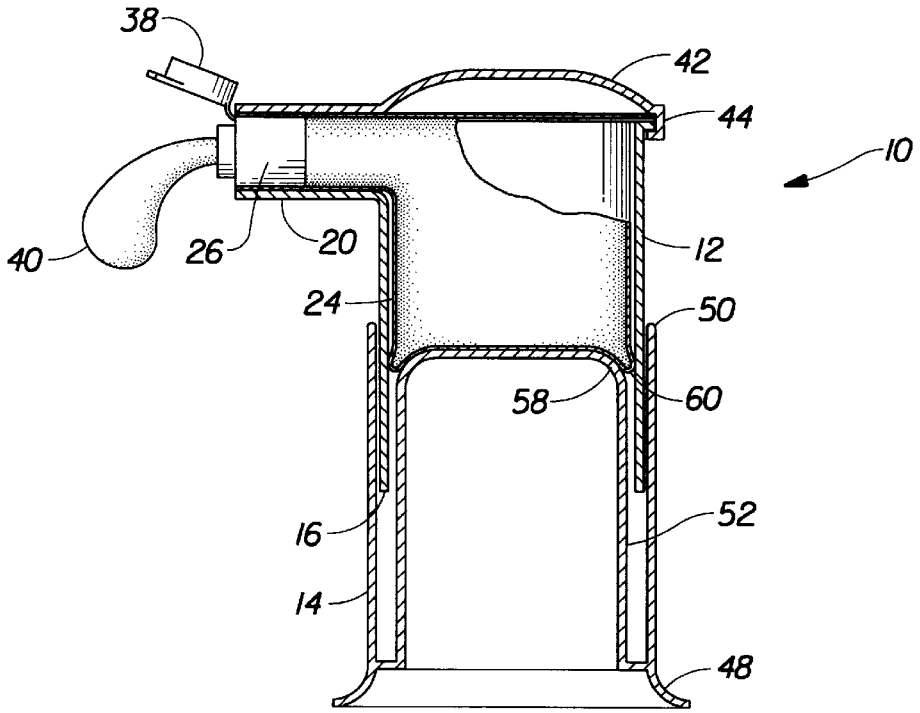
FIG. 4 is a sectioned side elevation view similar to FIG. 3, showing the flexible bag partially inverted by the post after the upper portion has been pressed against the bottom portion to dispense fluid.

FIGS. 3 and 4 show the assembly of dispenser 10 including: rigid cover 42 snap-fit onto flange 18 of upper portion 12; flexible bag 22 assembled as a cartridge, filled with fluid 40, and closed by film closure 28 and nozzle 26 with cap 38; and bottom portion 14 telescopingly engaged with upper portion 12 such that bag 22 rests atop curved end 58 of post 52.

FIG. 5 shows an alternative dispenser, generally indicated as 70, in which the nozzle is directed along the axis of telescoping upper and bottom portions. Dispenser 70 is a hand held dispenser intended to be operated by a user squeezing together telescoping parts to dispense viscous fluid through a substantially axial nozzle. Dispenser 70 has an upper portion 72 and a bottom portion 74 which telescope together. Portions 72 and 74 may have cylindrical or non-cylindrical shapes, however bottom portion 74 is located internally to upper portion 72.

Upper portion 72 has an annular member 76 and finger grips 78 and threaded end 80. Annular member 76 has an inner surface 77. Slidably fitting into inner surface 77 is a flexible bag 82, which has sidewall 84. Connected to flexible bag 82 is a nozzle 86. Nozzle 86 has a nozzle flange 88, an orifice 96 extending through nozzle 86 and in fluid communication with flexible bag 82, and a nozzle closure 98 adapted to close orifice 96. Nozzle closure 98 is preferably a screw-on cap as shown in FIG. 5.

Bag 82 is preferably preassembled as a replacement cartridge. That is, bag 82 is a folded and sealed film structure filled with a viscous fluid. Nozzle 86 is sealed to bag 82 by welding or adhesive. Nozzle closure 98 is preferably closed to seal the fluid in bag 82 during handling of bag 82 as a replacement cartridge.

When bag 82 is slidably assembled into annular member 76 of upper portion 72, a threaded collar 102 removably clamps nozzle flange 88 to upper portion 72. Thus, bag 82 and nozzle 86 may be easily replaced in upper portion 72 by removing threaded collar 102.

Bottom portion 74 preferably has a base 108 and a post 100, which telescopingly engages annular member 76, preferably inside of annular member 76. Post 100 has a rounded end 104. Post 100 loosely fits inside annular member 16 and clears inner surface 77 by more than four thicknesses of bag sidewall 84. Preferably, post 100 has an outer dimension which is equivalent to an inner dimension of inner surface 77 less four bag sidewall thicknesses less about 0.75 mm. With this amount of clearance, post 100 will cause bag 82 to invert when post 100 is pressed against the bottom of bag 82. Alignment is established between post 100 and bag 82 by means of the rounded end 104, which gradually initiates inversion. Inversion is underway by the time the outermost dimension of post 100 contacts bag 82. The inverting bag draws the post to the center of the annular member. Rounded end 104 preferably has a minimum radius of about 10% to 15% of the diameter of post 100.

In a particularly preferred embodiment of the present invention, as shown in FIGS. 1–4, annular member 16, annular member 50, and post 52 are oval in vertical cross-section so that there is minimal rotation possible between upper and lower portions. Such rotation would tend to twist bag 22 when it engages post 52 and thereby cause wrinkles to form which would hinder bag inversion. Alternatively, a vertical keyway and key could be adapted between telescoping annular members 16 and 50 if they were cylindrical in order to prevent rotation of upper and bottom portions relative to each other.

Bag 22 is preferably a cartridge which is suspended in annular member 16 by bag flange 32 resting atop flange 18 of upper portion 12. That is, bag 22 rests in position but is not directly connected there. In this situation, bag 22 may be grasped by nozzle 26 and removed when it is empty. However, the term "suspended" is intended to also include the condition where bag 22 is sealed or clamped to flange 18.

Flexible bag 22 is preferably thermoformed with flange 32 and nozzle portion 30. The nozzle and bag closure are separate pieces sealed together by heat welding or adhesive. For example, a cylindrical thermoformed bag 22 is made of 0.3 mm thick polyproplyene/EVOH coextruded film and has a diameter of 50 mm and a depth of 60 mm. Bag closure film is made of the same material and thickness and is fastened to the bag flange and nozzle by heat sealing.

Where additional barrier properties are required, bag 22 and bag closure 28 may be made of a foil laminate. For example, the construction of a tri-laminate bag sealed to a nozzle is generally in accordance with the teachings of commonly assigned U.S. Pat. No. 4,842,165 issued to Van Coney on Jun. 27, 1989, which is hereby incorporated by reference. Van Coney teaches an inverting bag having a tri-laminated structure of polyethylene, metalized polyester, and polyethylene, which has a sidewall thickness of about 0.04 mm.

In order to reduce part count, flexible bag 22 may be injection-blown or pressblown to provide a nozzle and bag as one piece. For example, the construction of a pressblown bag with flange and integral nozzle is generally in accordance with the teachings of commonly assigned U.S. Pat.

No. 5,305,921 issued to Kock et al. on Apr. 26, 1994, which is hereby incorporated by reference. Kock et al. teaches an inverting cylindrical pressblown bag made of low density polyethylene, which has a sidewall thickness of about 0.006 inches and a diameter of 1.6 inches.

Injection blown bags are known to have multiple layers, so that barrier properties can be included in a bag with integral nozzle and flange. Such a bag may be made of polypropylene and ethylene vinyl alcohol layers.

Upper portion 12 and bottom portion 14 are preferably injection molded of polypropylene, with average wall thicknesses of 1.2 mm. The clearance between telescoping members is approximately 0.5 mm, and there is an initial engagement of 20 mm before bag inverting for alignment purposes. When full, dispenser 10 is approximately 126 mm high and when empty it is approximately 88 mm high. A stroke of 1.27 mm dispenses approximately 1.1 ml of fluid. Preferred dimensions 54 and 56 are 49.5 mm and 50.5 mm, respectively.

While particular embodiments of the present invention have been illustrated and described, it will be obvious to those skilled in the art that various changes and modifications may be made without departing from the spirit and scope of the invention, and it is intended to cover in the appended claims all such modifications that are within the scope of the invention. For example, rigid cover 42 could be a flip-top closure hinged to upper portion 12 such that rigid cover 42 and upper portion 12 could be molded as one piece. Also, dispenser 10 could contain more than one flexible bag 22 and more than one post 52 positioned to invert each bag. In such a case it may be desirable to have a common nozzle 26 for all flexible bags and to have all bags interconnected with the common nozzle to form a single cartridge.

What is claimed is:

1. A reclosable flexible bag cartridge for containing a fluid comprising:

a) a nozzle having a substantially flat top surface and a continuous outer portion adjacent said top surface, said nozzle also having an orifice extending therethrough, said orifice having an orifice axis, an outermost end, and a reclosable closure located at said outermost end;

b) a thermoformed bag having an inside, a sidewall, a bottom, and a flanged end, said bag being open at said flanged end, said flanged end having a flange extending substantially radially outward from said sidewall, said flange being continuous and in a plane except at a nozzle-fitting portion whereat said flange is shaped to wrap around said continuous outer portion of said nozzle, said flange at said nozzle-fitting portion being bonded to said continuous outer portion of said nozzle such that said top surface of said nozzle resides substantially within said plane of said flange; and c) a substantially flat piece of film bonded to said flange and to said top surface of said nozzle such that said cartridge is sealed closed by said piece of film, said orifice in said nozzle providing exclusive fluid communication with said inside of said bag.

2. The flexible bag cartridge of claim 1 wherein said orifice axis is substantially parallel to said plane of said flange.

3. The flexible bag cartridge of claim 1 wherein said sidewall of said bag is thin enough and large enough in diameter that said bag is emptied by inverting said bag.

4. The flexible bag cartridge of claim 1 wherein said bag is made of a laminated structure capable of providing barrier properties to said bag.

5. The flexible bag cartridge of claim 1 wherein said bag is handled by grasping said nozzle.

6. The flexible bag cartridge of claim 1 wherein said reclosable closure is a flip-top cap.

7. The flexible bag cartridge of claim 1 wherein a fluid is placed into said bag, said fluid having a level just below said plane of said flange.

8. The flexible bag cartridge of claim 1 wherein said thermoformed bag is filled prior to bonding said flat piece of film to said flange of said bag.

9. The flexible bag cartridge of claim 1 wherein said bag is filled through an opening different than said orifice in said nozzle.

* * * * *